US005980343A

United States Patent [19]

Rolinski

[11] Patent Number: 5,980,343

[45] Date of Patent: Nov. 9, 1999

[54] EXHAUST SYSTEM FOR MARINE VESSELS

[75] Inventor: Adam Rolinski, West Olive, Mich.

[73] Assignee: S2 Yachts Inc., Holland, Mich.

[21] Appl. No.: 09/030,210

[22] Filed: Feb. 25, 1998

Related U.S. Application Data

[60] Provisional application No. 60/040,039, Mar. 5, 1997.

[51] Int. Cl.[6] ..... B63H 21/32

[52] U.S. Cl. ..... 440/89

[58] Field of Search ..... 440/38, 46, 47, 440/88, 89

[56] References Cited

U.S. PATENT DOCUMENTS

| | | | |
|---|---|---|---|
| 3,371,645 | 3/1968 | Ward | 440/89 |
| 4,019,456 | 4/1977 | Harbert | 440/89 |
| 4,509,927 | 4/1985 | Ikeda . | |
| 5,078,631 | 1/1992 | Harbert . | |
| 5,505,644 | 4/1996 | Ousley, II et al. . | |
| 5,700,172 | 12/1997 | Ousley, II et al. . | |

OTHER PUBLICATIONS

Exhibit A—Photographs 1, 2 and 3.

*Primary Examiner*—Stephen Avila

*Attorney, Agent, or Firm*—Price, Heneveld, Cooper, DeWitt & Litton

[57] ABSTRACT

A two pathway exhaust and water discharge through-hull system is coupled to a muffler for separating exhaust gases and cooling water at operating speeds such that at low engine speeds exhaust gases and water are discharged through a first outlet preferably above the waterline and, when the engine speed is increased above a predetermined level, exhaust gases are discharged through a second outlet which communicates with a streamlined, low back-pressure underwater discharge skeg and water is discharged through the first outlet. In a preferred embodiment of the invention, a discharge skeg is positioned at each comer of the transom for a twin engined vessel. In a preferred embodiment also, each of the underwater discharge skegs is mounted to the bottom of the hull and includes a mounting flange and an upwardly extending collar which extends through the hull and is coupled to an adapter for coupling the discharge skeg to an exhaust outlet of a muffler. As a result, an exhaust system is provided which is efficient, quite and which discharges exhaust gases underwater and away from the vessel when underway at normal operating speeds.

24 Claims, 5 Drawing Sheets

EXHAUST SYSTEM FOR MARINE VESSELS

CROSS-REFERENCE TO RELATED APPLICATION

This application claims priority under 35 U.S.C. § 119(*e*) on U.S. Provisional Application No. 60/040,039 entitled EXHAUST AND MUFFLER SYSTEM FOR MARINE VEHICLES, filed on Mar. 5, 1997, for Applicant Adam Rolinski, the entire disclosure of which is incorporated herein by reference.

BACKGROUND OF THE INVENTION

This invention relates to an exhaust system for marine vessels such as yachts and smaller boats with inboard engines and particularly to a system for the underwater discharge of exhaust gases and the separation of exhaust gases and water prior to discharge from the system at running speeds.

Marine vessels such as yachts and boats incorporate gas or diesel engines for propulsion. Such engines produce foul smelling exhaust gases, soot and a significant level of engine noise. A challenge in the design of pleasure boats and yachts is to simnultaneously efficiently discharge such exhausts from the engines, minimize the passenger's contact with a such exhaust gases and reduce engine noise.

One solution to the engine noise problem is to provide a muffler which receives the exhaust gases and discharges the gas from the boat above the waterline. It is also known to discharge the exhaust gases below the waterline or a combination of above and below the waterline. Known mufflers include a dry system that uses baffles to muffle the sound and wet systems that mix water drawn in through a hull fitting with the exhaust gases. Typically, the water is mixed with the hot exhaust gases and then simultaneously discharged from the boat through a single common outlet. Below the waterline discharge systems provide a more effective means for muffling the engine noise than above the waterline systems except that an underwater system can result in back pressure for the engines and "burping" of the gases at idle or slow speeds.

SUMMARY OF THE PRESENT INVENTION

The system of the present invention overcomes the problems of prior art exhaust systems by utilizing a two pathway exhaust and water discharge through-hull system which is coupled to a muffler for separating exhaust gases and cooling water at operating speeds such that at low engine speeds exhaust gases and water are discharged through a first outlet(s) preferably above the waterline and, when the engine speed is increased, exhaust gases are discharged through a second gas outlet which communicates with a streamlined, low back-pressure underwater discharge skeg and only water is discharged through the first outlet. In a preferred embodiment of the invention, a discharge skeg is mounted to the bottom of the hull and positioned at each comer of the transom for a twin engined vessel. In a preferred embodiment also, each of the underwater discharge skegs includes a mounting flange and an upwardly extending collar which extends through the hull and is coupled to an adapter for sealably coupling the discharge skeg to the hull and to an exhaust outlet of a muffler. As a result, an exhaust system is provided which is efficient, quite and which discharges exhaust gases underwater and away from the vessel when underway at normal operating speeds.

These and other features, objects and advantages of the present invention will become apparent upon reading the following description thereof together with reference to the accompanying drawings.

DETAILED DESCRIPTION OF THE PREFERRED EMBODIMENT

Figure 1:
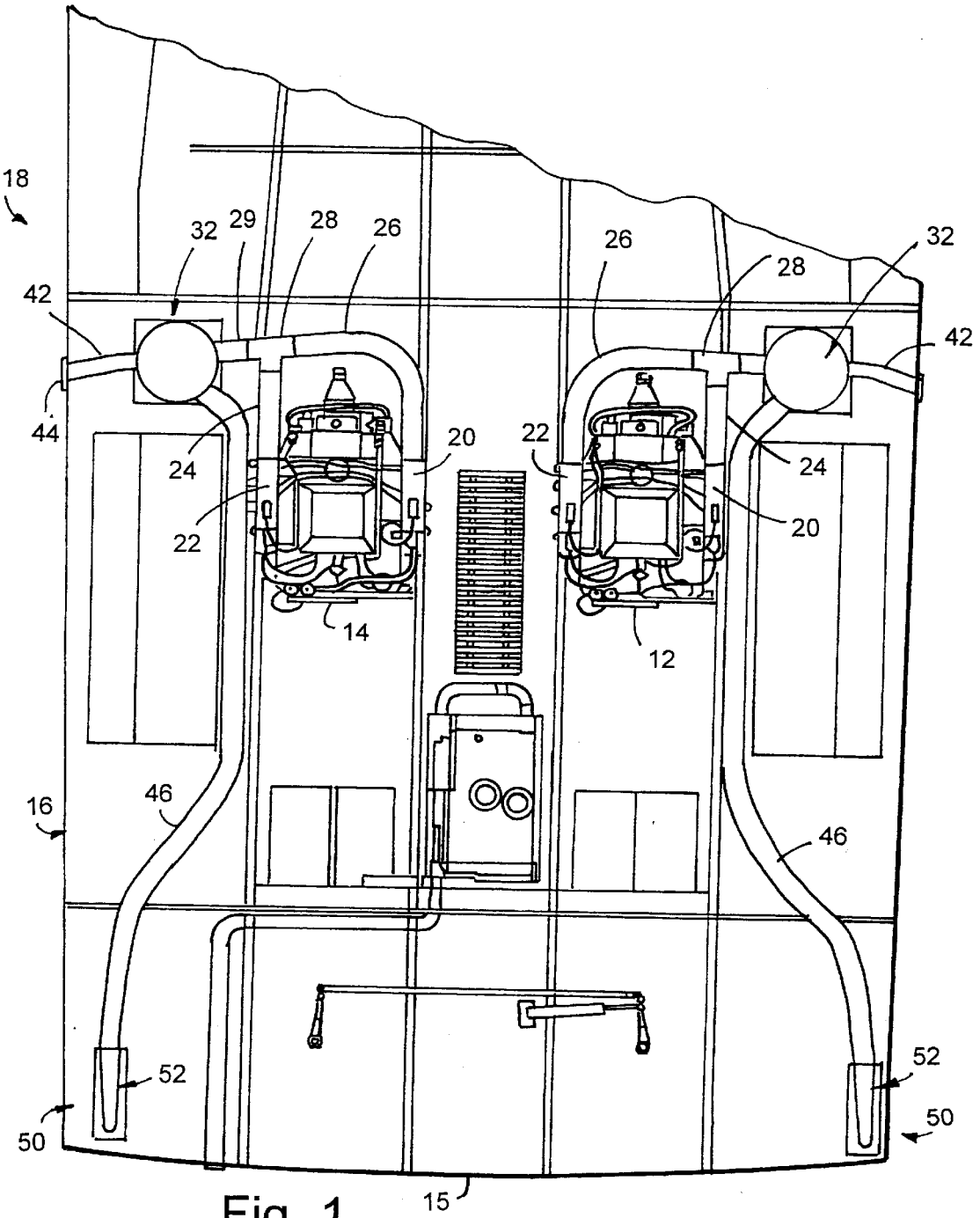
FIG. 1 is a fragmentary top plan, schematic view of a twin engine vessel incorporating a muffler and exhaust system according to the invention.

Referring now to the drawings and to FIG. 1 in particular, there is shown a fragmentary plan schematic view of a twin gasoline engine vessel incorporating mufflers and an exhaust system according to the present invention. In this embodiment, starboard and port conventional gasoline internal combustion engines 12, 14 are mounted inside the hull 16 of the vessel 18. The structure of the starboard and port engines, mufflers, and exhaust system are identical and, therefore, only one system will be described in detail.

Figures 2, 3, 5:
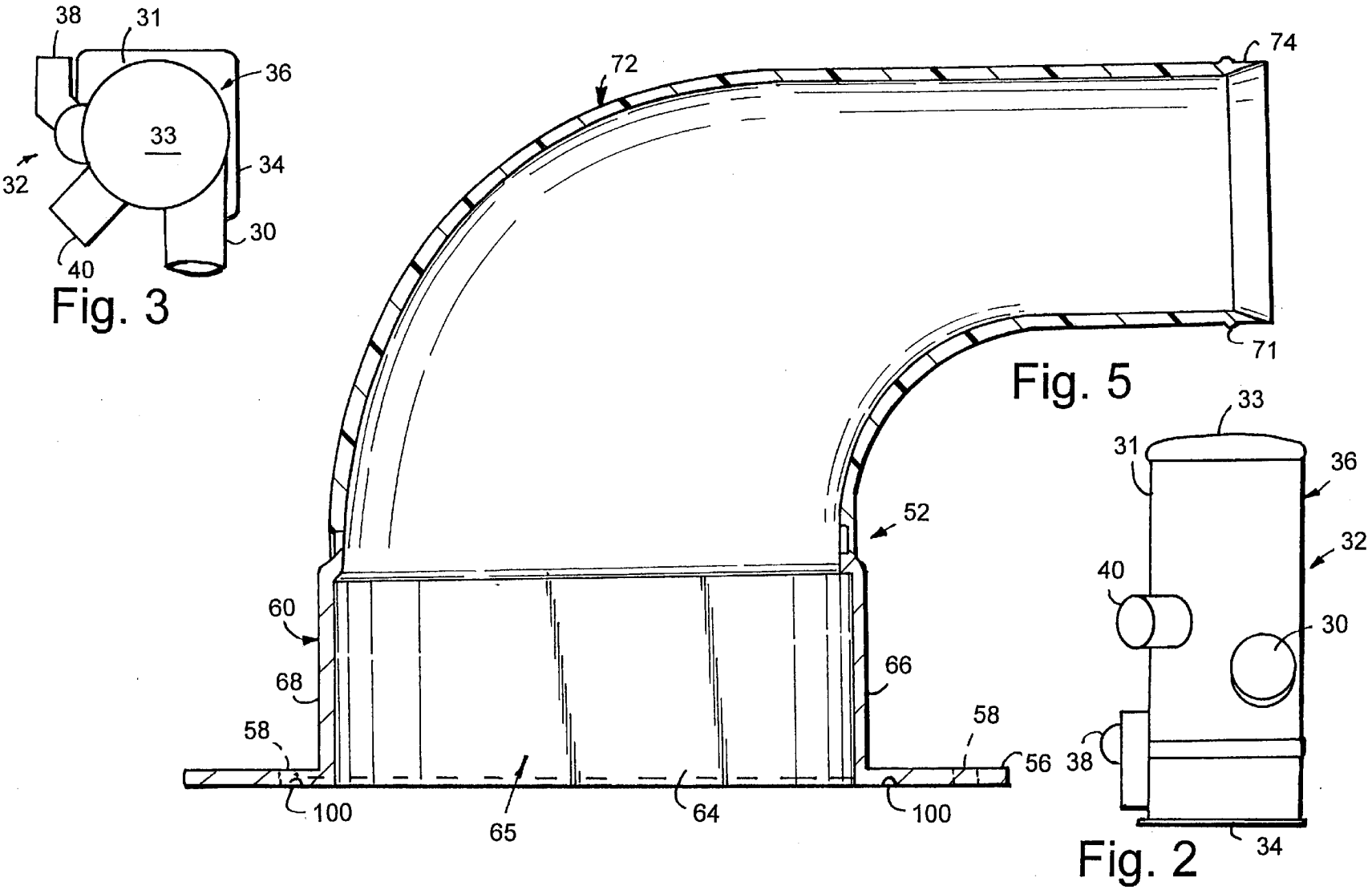
FIG. 2 is a side elevational view of the port muffler shown in FIG. 1 for use according to the invention.
FIG. 3 is a top plan view of the muffler of FIG. 2.
FIG. 5 is a vertical cross-sectional view of the skeg adapter taken along lines V—V of FIG. 4.
Figure 4:
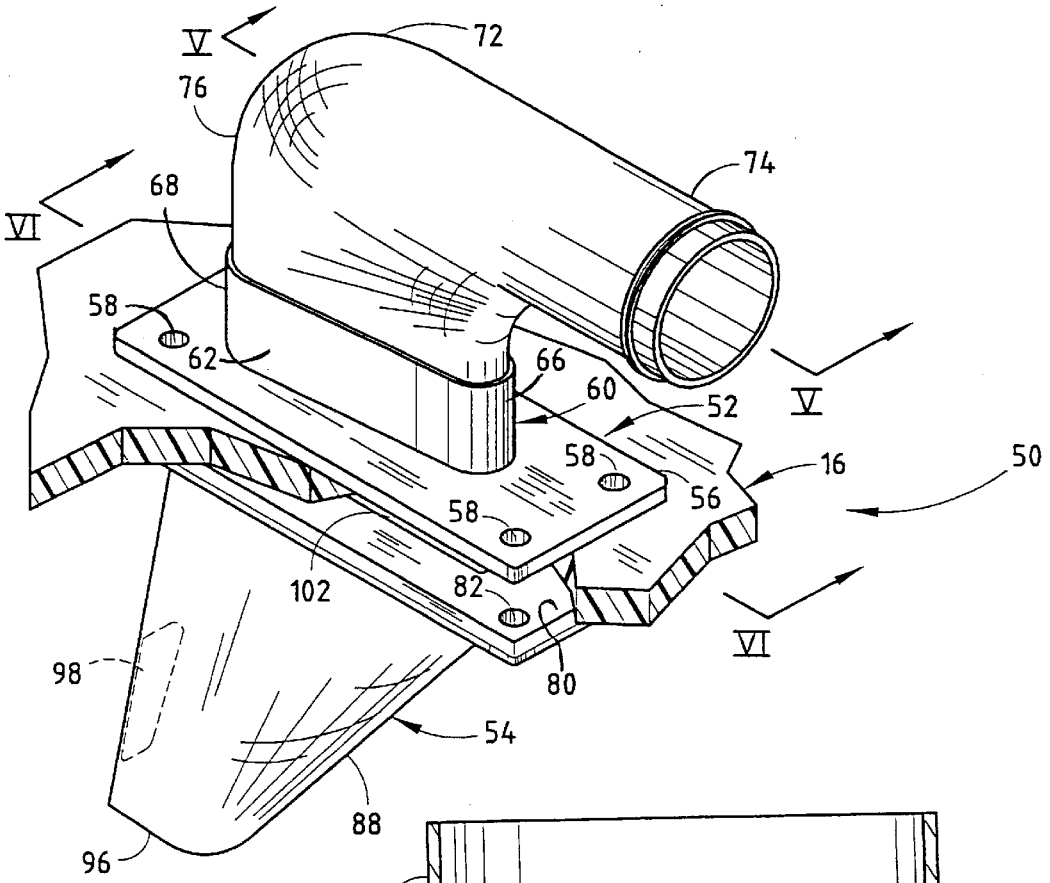
FIG. 4 is a perspective view of the exhaust discharge skeg assembly of the exhaust system of the invention.

Each engine includes a pair of exhaust manifolds 20, 22 provided thereon which convey the hot exhaust gases from the piston cylinders to the exhaust and muffler system. As in other conventional gas internal combustion engines, water is sprayed into the exhaust gas stream inside or adjacent to the exhaust manifold. The water is drawn into the engine through a conventional through-hull fitting (not shown) by a conventional water pump (not shown). A pair of gas conduits 24, 26 extend from the manifolds 20, 22 and terminate at a T-connector 28. The gas and water mixtures from each manifold are commingled in the T-connector 28 and are conducted to the inlet port 30 (FIG. 2) of muffler 32 through a conduit 29. Muffler 32 is mounted to hull 16 to extend vertically in the vessel oriented as seen in FIGS. 1 and 2. As seen in FIGS. 1–3, the inlet port 30 extends tangentially onto the cylindrical housing 36 (FIG. 2) of the muffler 32 at a location approximately one-third of the distance up from the bottom 34 of the muffler. Therefore, as the hot gas and water mixture enters the circular housing 36 of the muffler 32, circular or cyclonic flow of this gas and water mixture is created along the inner wall of muffler 32. When the velocity of such mixture increases at certain engine speeds, the exhaust gas and water mixture is separated into its constituent elements of waste water and exhaust gas.

As seen in FIGS. 1–3, a first or water outlet 38 extends into muffler housing 36 below the inlet port 30 and near bottom 34. Outlet 38 is, as best seen in FIG. 3, angularly disposed on the opposite side of housing 36 from inlet 30 and extends tangentially from the sidewall 31 of muffler 32 in a direction opposite inlet 30. A second or gas outlet 40 extends into muffler 32 above the inlet port 30 about midway on the circular housing 36. As best seen in FIGS. 2 and 3, outlet 40 is angularly located between inlet 30 and first outlet 38 and extends not tangentially but instead orthogonally through wall 31 of muffler 32. Cylindrical muffler 32 is preferably made of fiberglass and has a diameter of about 13 inches and a height of about 31 inches and is enclosed with a domed top 33. The diameter of inlet 30 is about 15 inches, first outlet 38 is 3 inches and second outlet 40 is 4 inches. At low engine speeds such as idling below 1000 rpm, gas and water both exit first outlet 38. At higher engine speeds as the exhaust velocity increases, the gas and water mixture enters the circular housing 36 through the tangentially oriented inlet port 30, circular or cyclonic flow is created inside the circular housing 36 causing the waste water to drop in the housing for discharge through the water outlet 38 whereas the exhaust gases are separated from the water and pass through the gas outlet 40. A conduit 42 extends from the first outlet 38 to a conventional brass through-hull fitting 44 for discharge into the water outside the hull. Preferably, the through-hull fitting 44 is positioned above the waterline of the vessel 18 at least when the vessel is not underway.

As seen in FIGS. 1 and 4–6, an exhaust gas conduit 46 extends from the second or gas outlet 40 of muffler 32 rearwardly to an underwater gas discharge skeg assembly 50 for discharge from the vessel 18. The skeg assembly 50 comprises a skeg adapter 52 positioned inside the boat hull 16 which mates with an underwater exhaust discharge skeg 54 mounted to the bottom of the hull 16 near each corner of the transom 15, as seen in FIG. 1. The skeg adapter 52 is integrally cast of a material suitable for the marine environment, such as bronze, and includes a base plate or mounting flange 56 having a plurality of fastener apertures 58 formed therein and a hollow, generally elliptical collar 60 extending upwardly therefrom. Preferably, the collar 60 comprises a pair of non-parallel side walls 62, 64, a rounded leading edge 66, and a rounded trailing edge 68. The radius of the leading edge 66 is less than that of the trailing edge 68 so that the profile of the collar 60 is wider adjacent the trailing edge 68 than adjacent the leading edge 66. Adapter 52 integrally includes an elbow conduit 72 serving as a transition section extending from generally elliptical collar 60 and terminating at a circular inlet end 74 adapted to receive the terminal end of the circular exhaust gas conduit 46. End 74 includes an external circular sealing bead 71 to assist in sealably attaching exhaust hose or conduit 46 to adapter 52 by the use of conventional hose clamps. The elbow connector 72, thus, provides a smooth transition from the preferably circular cross section of the exhaust gas conduit 46 to the generally elliptical cross section of the gas discharge opening 65 of skeg adapter 52. The bottom surface of base or mounting flange 56 includes an upwardly extending continuous recess 100 (FIG. 5) for receiving conventional marine sealing material for sealing the adapter to the inside of hull 16 when through-hull fasteners couple adapter 52 and skeg 54.

The skeg 54 comprises an integrally cast member which is generally streamlined to minimize underwater drag. Exhaust skeg 54 is trapezoidal when viewed from the side (FIG. 6) and thin with curved sidewalls, a narrow rounded leading edge 86 and an exhaust outlet 98 along the lower trailing edge. Exhaust skeg 54 includes a base plate or mounting flange 80 with a plurality of fastener apertures 82 formed therein to align with the fastener apertures 58 of the skeg adapter base plate 56. A hollow elliptical collar 84 extends upwardly from plate 80. The shape of the collar 84 is selected to fit within the interior surface collar 60 of skeg adapter 52. Collar 84 has a height which extends through the thickness of hull 16 which includes an aperture sized to closely receive upstanding collar 84. The hollow body 86 of skeg 54 extends downwardly from the base plate 80 and has a rearwardly and downwardly tapered leading edge 88, a pair of opposed, non-parallel side walls 90, 92, a trailing edge 94 and a bottom edge 96. Preferably, the cross section of the skeg body 86 comprises a hydrodynamically efficient foil shape which is symmetrical about its centerline. The leading edge 88 is rounded and has a relatively small radius of curvature whereas the trailing edge 94 is substantially planar and dimensioned so that the side walls 90, 92 diverge away from one another as the distance from the leading edge 88 increases. The sides 90, 92 converge slightly at the trailing rounded edge 94 of the skeg 54. The skeg body 86 is hollow and has an exhaust outlet aperture 98 formed through at least a substantial portion of the trailing edge 94. The mounting base or flange 80 of skeg 54 includes a recess 102 extending continuously around the upper surface of flange 80 adjacent the intersection of the plate 82 and collar 84. Recess 102 receives a conventional marine sealant.

The skeg adapter 52 and skeg 54 are adapted to be assembled to one another through the hull on opposite sides of the bottom to create the skeg assembly 50. The elliptical collar 84 of the exhaust skeg 54 is telescopically received inside the hollow interior of the collar 60 of the skeg adapter 52. In the assembled condition, the two base plates 56, 80 are aligned and abut opposite sides of the hull. Conventional threaded fasteners extend through the apertures 58, 82 of the two plates 56, 80, respectively, for securing these two members to one another and the resultant skeg assembly 50 to the hull 16. A bead of conventional marine sealant is provided in the sealant grooves 100, 102, respectively, prior to assembly of the two members to the hull. Once assembled, the sealant prevents water from leaking into the hull 16.

The exhaust system according to the invention provides significant improvements over prior exhaust systems. In operation, exhaust gases generated by operation of the engines 12, 14 are mixed with water in or adjacent to the manifolds 20, 22. The gas and water mixture enters the mufflers 32. Below a predetermined engine speed, typically while the vessel is at a dock and the engines are idling, insufficient cyclonic flow is created inside the muffler to separate the gas and water mixture. Additionally, not enough water volume flows to seal or fill the water outlet 38, allowing a path for gases to flow out of outlet 38. Therefore, all of the gas and water will be discharged from the boat through the water outlet 38, waste water conduit 42, and ultimately, the through-hull fitting 44. As the engine speed increases, sufficient velocity of fluid flow generated by the expulsion of the exhaust gases and injection of water creates a cyclonic flow inside the cylindrical muffler housing 36 to separate the exhaust gases from the waste water. Sufficient water is pumped to muffler to occupy all space in water outlet 38 such that the gases are rerouted to outlet 40 of muffler 32. The pressure difference between inlet 30 and outlet 38 must be greater than between inlet 30 and outlet 40 for this to occur. Preferably, the desired, transitional engine speed is approximately 1,000 rpm. As the engine speed exceeds this level, the water separates from the gas and is discharged through the through-hull fitting 44. The gases, on the other hand, are discharged from the muffler 32 through the gas outlet 40 and are conducted to the skeg assembly 50 via the exhaust gas conduit 46 and conduit connector 74. The exhaust gases flow through the collars 60, 84 into the hollow skeg body and are discharged rearwardly from the boat through the outlet aperture 98 provided in the trailing edge 94. The skeg assemblies 50 are mounted on the boat hull 16 so that the skegs 54 are positioned beneath the waterline when the vessel is at rest and at planing speeds. Therefore, above the threshold engine speed where gas and water separation occurs and the back pressure of outlet 40 is less than at outlet 38, most of the exhaust gases are discharged from the boat 18 through the outlet aperture 98 of the skeg member 54, below the waterline.

Figure 9:
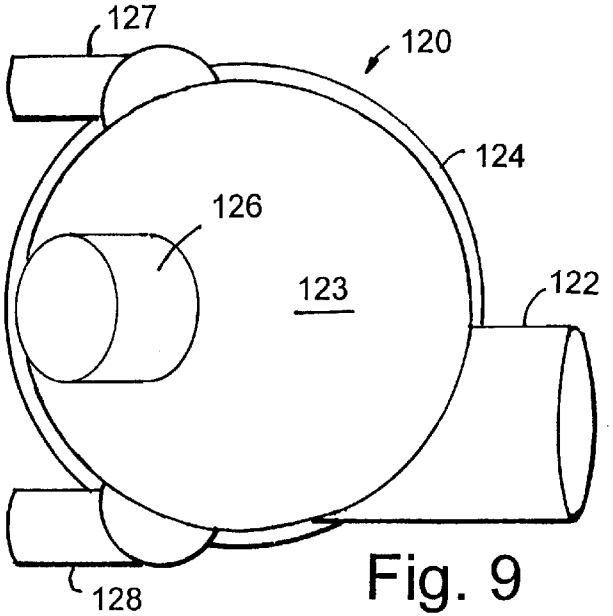
FIG. 9 is a top plan view of the muffler shown in FIG. 8.

Separation of the gas and water above certain engine speeds in combination with the position and contour of the skeg assembly 50, results in several significant advantages. First, the engine noise level is dramatically reduced. Secondly, the odorous exhaust gasses are discharged underwater in the wake of the vessel. With this structure, it has been found that little or no exhaust gases roll back up into the passenger cockpit area, known as the station wagon effect, under normal operating conditions. The aerodynamic contour of the skeg 54 effectively channels and discharges the exhaust gases into the water where the noise is absorbed and effectively conducted away from the moving vessel. The first embodiment of the exhaust and muffler system described above in reference to FIGS. 1–6 is ideally suited for a gasoline burning internal combustion engines. This system can be employed for use for diesel engines as shown in FIGS. 7–9 now described.

Figure 6:
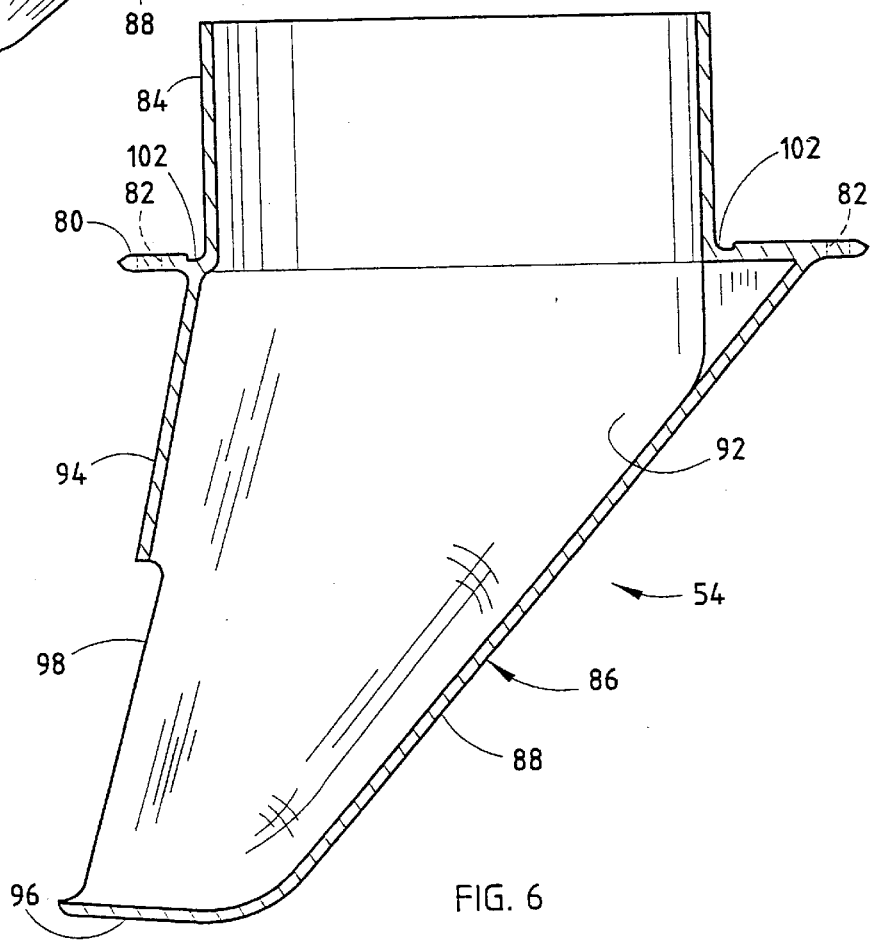
FIG. 6 is a vertical cross-sectional view of the exhaust skeg taken along lines VI—VI of FIG. 4.
Figure 7:
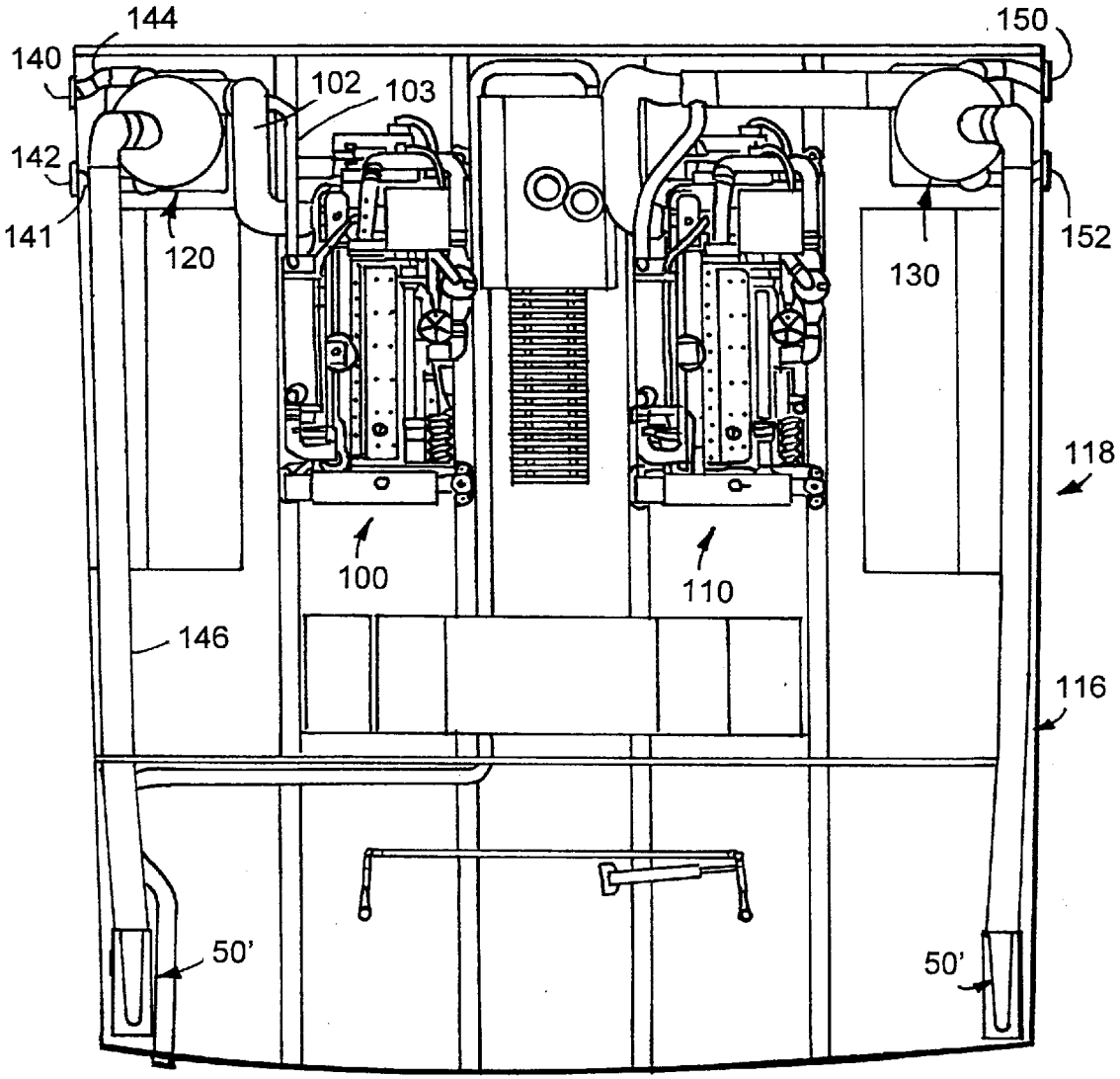
FIG. 7 is a fragmentary top plan schematic view of a vessel having a twin diesel engine exhaust system of the present invention.
Figure 8:
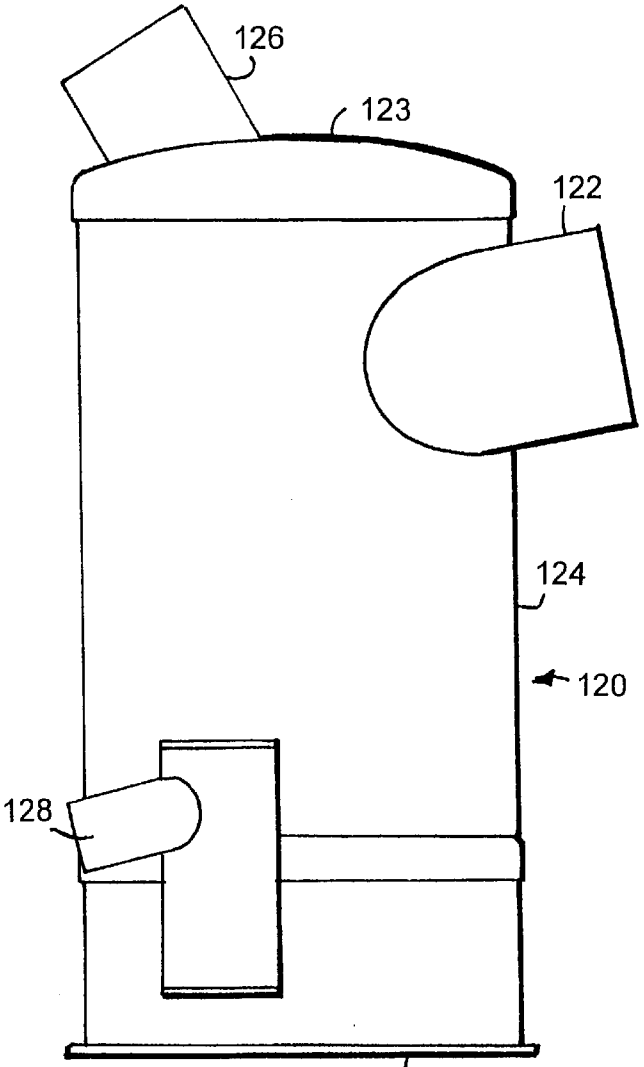
FIG. 8 is a rear elevational view of the port muffler shown in FIG. 7.

Referring to FIG. 7, there is shown a vessel 118, such as a 40 foot express yacht manufactured by S2 Yachts Inc. of Holland, Michigan, which includes a hull 116 which, as shown schematically in FIG. 7, includes port and starboard engines 100, 110, respectively. Engines 100, 110 are diesel engines which are in-line six-cylinder turbo-charged engines with an exhaust system according to the present invention which is substantially similar as that described in the embodiment shown in FIGS. 1–6 with the exception that the exhaust passageways and muffler are somewhat larger for the increased volume of exhaust gases and water discharged by the larger engines. Also, each of the mufflers 120, 130 include dual outlets as described below. The exhaust systems and engine installations are mirror images of one another, such that only the port installation is described in detail in connection with FIGS. 7–9.

The port engine 100 includes an exhaust riser 102 extending from the engine to which there is injected through hose 103 a substantial amount of cooling water for the hot exhaust gases which enter muffler 120 through an exhaust inlet 122 located near the top of the muffler 120. Muffler 120 includes a cylindrical sidewall 124, a bottom 121 and a domed top 123 which includes an exhaust gas outlet 126. Extending outwardly from the opposite sides of the muffler 120 are water outlets 127 and 128 which are coupled to through-hull fittings 140, 142 above the waterline of the hull by means of hoses 141, 144 connected by conventional hose clamps. An exhaust hose 146 is coupled to the outlet 126 of muffler 120 and extends aft in the vessel to an exhaust skeg assembly 50' which is substantially identical to the skeg 50 shown in FIGS. 4–6 with the exception that it is somewhat larger such that the discharge apertures 65 and 98 therein are somewhat larger to accommodate the greater flow of gases from the larger diesel engines.

As can be appreciated, mufflers 120 and 130 may be somewhat larger in overall size and scaled up in dimension than the muffler 32 in the gasoline version of the exhaust system of the present invention. As in the first embodiment, the inlet 122 is positioned below the gas outlet 126 while the water outlets 127 and 128 are located near the bottom 121 of the muffler 120. The starboard engine 110 includes similar connections to its muffler 130 which, in turn, is coupled to through-hull fittings 150, 152 for the discharge of water and gas and water when the engines are idling therefrom as well as to an exhaust gas skeg assembly 50' on the starboard corner of the transom area of the vessel.

In the embodiment shown in FIGS. 7–9, at low engine speeds, such as at idling below or near 1000 rpm, exhaust gas and water are discharged through the above water dual through-hull fittings 140, 142, 150, 152. As engine speed is increased above the idle speed when the vessel is underway, the heavier water tends to separate and drop by centrifugal action in the mufflers 120, 130, and the increased gas velocity and venturi action of the movement of exhaust skegs 54 through the water assists in drawing the gases through underwater exhaust opening 98 (FIG. 6). In the diesel version shown in FIGS. 7–9, exhaust opening 98 may be larger (i.e. extend a greater distance along trailing edge 94 of skeg 54). Thus, at running speeds, gas escapes through the gas discharge port 126 of the muffler and be discharged through the underwater exhaust skeg assemblies 50' while water collected at the bottom of the muffler drains through the through-hull fittings from the discharge outlets 127, 128 of muffler 120 and similar outlets on muffler 130. Thus, the exhaust system shown in FIGS. 7–9 functions to efficiently discharge cooling water as well as exhaust gases from the vessel discharging the exhaust gases into and below the slip behind the vessel when underway through the use of the exhaust skegs 50' of a construction substantially the same as that shown in FIGS. 4–6.

For different vessels and/or different engines, the size of the mufflers, number of seawater discharge openings and size of the skeg assemblies can be appropriately scaled up or down. Such reasonable variations and modifications are possible within the spirit of the foregoing specification and drawings without departing from the scope of the invention.

It will become apparent to those skilled in the art that various modifications to the preferred embodiments of the invention as described herein can be made without departing from the spirit or scope of the invention as defined by the appended claims.

The invention claimed is:

1. An exhaust system for an engine of a marine vessel comprising:

a muffler for separating the exhaust gas and water components from a marine engine exhaust above a predetermined engine speed, said muffler having an exhaust gas inlet adapted to be coupled to an engine, an exhaust gas outlet, and at least one water outlet;

conduit means coupling said water outlet to a first through-hull fitting adapted to be positioned above the waterline of a vessel for exhausting substantially all of the engine exhaust gas and engine cooling water below said predetermined speed;

an exhaust skeg assembly including an underwater exhaust skeg; and exhaust conduit means for coupling said skeg assembly to said gas outlet of said muffler for discharging substantially only the engine exhaust gas below the vessel waterline when the engine is above said predetermined speed.

2. The exhaust system as defined in claim 1 wherein the skeg assembly comprises a hollow generally trapezoidal shaped exhaust skeg having curvilinear sides, a narrowly rounded leading edge and an exhaust port formed through a trailing edge.

3. The exhaust system as defined in claim 1 wherein said predetermined engine speed is about 1000 RPM.

4. An exhaust system for a marine vessel comprising:

a muffler for separating the exhaust gas and water components from a marine engine exhaust, said muffler having an exhaust gas inlet adapted to be coupled to an engine, an exhaust gas outlet, and at least one water outlet;

conduit means coupling said water outlet to a first through-hull fitting adapted to be positioned above the waterline of a vessel;

an exhaust skeg assembly including an underwater exhaust skeg, wherein said skeg assembly comprises a hollow generally trapezoidal shaped exhaust skeg having curvilinear sides, a narrowly rounded leading edge and an exhaust port formed through a trailing edge, and wherein said exhaust skeg further includes an upwardly extending collar communicating with the hollow interior of said exhaust skeg and a peripheral sealing recess extending adjacent said upwardly extending collar for receiving a sealing material and a peripheral flange for sealably mounting said skeg to the bottom of the vessel with said collar extending upwardly through an aperture formed in the hull; and exhaust conduit means for coupling said skeg assembly to said gas outlet of said muffler for discharging gas below the vessel waterline.

5. The exhaust system as defined in claim 4 wherein said skeg assembly further includes a skeg adapter having a collar mateably receiving said collar of said exhaust skeg and an elbow for coupling to said exhaust conduit means extending between said skeg adapter and said gas outlet of said muffler.

6. The exhaust system as defined in claim 5 wherein said skeg adapter includes a mounting flange communicating with said collar and a sealing recess extending around said mounting flange adjacent said collar for receiving a sealing material for sealably attaching said skeg adapter to the inside of a hull in aligned mating relationship to said exhaust skeg.

7. The exhaust system as defined in claim 6 wherein said mounting flange of said exhaust skeg and said mounting flange of said skeg adapter include aligned apertures therein for receiving through-hull fasteners for attaching said skeg adapter and exhaust skeg to opposite sides of the hull of a vessel.

8. An exhaust system for a marine vessel comprising:

a muffler for separating the exhaust gas and water components from a marine engine exhaust, said muffler having an exhaust gas inlet adapted to be coupled to an engine, an exhaust gas outlet, and at least one water outlet, wherein said muffler comprises a generally cylindrical, vertically extending housing with a cylindrical wall and wherein said gas inlet extends tangentially through said cylindrical wall;

conduit means coupling said water outlet to a first through-hull fitting adapted to be positioned above the waterline of a vessel;

an exhaust skeg assembly including an underwater exhaust skeg; and exhaust conduit means for coupling said skeg assembly to said gas outlet of said muffler for discharging gas below the vessel waterline.

9. The exhaust system as defined in claim 8 wherein said gas outlet is positioned vertically above said gas inlet and extends outwardly from said wall of said muffler.

10. The exhaust system as defined in claim 9 wherein said at least one water outlet extends from said cylindrical wall and is positioned below said gas inlet.

11. An exhaust skeg assembly for a marine vessel comprising:

a generally hollow exhaust skeg having curvilinear sides, a narrow rounded leading edge and an exhaust port formed in the trailing edge thereof, wherein said leading edge tapers toward said trailing edge from top to bottom to define a trapezoidal profile skeg; and a skeg adapter mateably coupled to said exhaust skeg and including means at an end remote from said exhaust skeg for coupling to an exhaust conduit.

12. The Exhaust skeg assembly as defined in claim 11 wherein said exhaust skeg includes an upwardly extending collar.

13. An exhaust skeg assembly for a marine vessel comprising:

a generally hollow trapezoidal shaped exhaust skeg having curvilinear sides, a narrow rounded leading edge and an exhaust port formed in the trailing edge thereof, wherein said exhaust skeg includes an upwardly extending collar, and wherein said exhaust skeg includes a peripheral mounting flange including a sealing groove extending adjacent said upwardly extending collar for mounting said skeg to the bottom of a vessel with said collar extending upwardly through an aperture formed in the vessel; and a skeg adapter mateably coupled to said exhaust skeg and including means at an end remote from said exhaust skeg for coupling to an exhaust conduit.

14. The exhaust skeg assembly as defined in claim 13 wherein said skeg adapter includes a mounting flange communicating with said collar and a sealing recess extending around said mounting flange adjacent said collar for receiving a sealing material for attaching said skeg adapter to the inside of a hull in aligned mating relationship to said exhaust skeg.

15. An exhaust system for an engine of a marine vessel comprising:

a muffler for separating the exhaust gas and water components from a marine engine exhaust above a predetermined engine speed, said muffler having an exhaust gas inlet adapted to be coupled to an engine, an exhaust gas outlet spaced in opposed relationship to said inlet, and at least one water outlet for exhausting substantially all of the engine exhaust gas and engine cooling water below said predetermined engine speed;

a substantially thin streamlined underwater exhaust skeg for mounting to the bottom of a vessel; and means for coupling said exhaust skeg to said gas outlet of said muffler for discharging substantially only the engine exhaust gas below the vessel waterline when the engine is above said predetermined speed.

16. The exhaust system as defined in claim 15 wherein said exhaust skeg comprises a hollow generally trapezoidal shaped skeg having curvilinear sides, a narrowly rounded rearwardly tapered leading edge, and an exhaust port formed through a trailing edge.

17. The exhaust system as defined in claim 16 wherein said exhaust skeg includes an upwardly extending generally elliptical collar communicating with the hollow interior of said exhaust skeg.

18. An exhaust system for a marine vessel comprising:

a muffler for separating the exhaust gas and water components from a marine engine exhaust, said muffler having an exhaust gas inlet adapted to be coupled to an engine, an exhaust gas outlet spaced in opposed relationship to said inlet, and at least one water outlet;

a substantially thin streamlined underwater exhaust skeg for mounting to the bottom of a vessel, wherein said exhaust skeg comprises a hollow generally trapezoidal shaped skeg having curvilinear sides, a narrowly rounded rearwardly tapered leading e, an exhaust port formed through a trailing edge, and an upwardly extending generally elliptical collar communicating with the hollow interior of said exhaust skeg, and wherein said exhaust skeg includes a peripheral sealing recess extending adjacent said upwardly extending collar for receiving a sealing material and a peripheral flange for sealably mounting said skeg to the bottom of the vessel with said collar extending upwardly through an aperture formed in the hull; and means for coupling said exhaust skeg to said gas outlet of said muffler for discharging gas below the vessel waterline.

19. The exhaust system as defined in claim 18 wherein said means for coupling said exhaust skeg to said gas outlet includes a skeg adapter having a collar shaped to mate with said collar of said exhaust skeg and a transition section terminating in a generally circular end for coupling to a gas conduit.

20. The exhaust system as defined in claim 19 wherein said skeg adapter includes a mounting flange communicating with said collar and a sealing recess extending around said mounting flange adjacent said collar for receiving a sealing material for attaching said skeg adapter to the inside of a hull in aligned mating relationship to said exhaust skeg.

21. The exhaust system as defined in claim 20 wherein said mounting flange of said exhaust skeg and said mounting flange of said skeg adapter include aligned apertures therein for receiving through-hull fasteners for attaching said skeg adapter and exhaust skeg to opposite sides of the hull of a vessel.

22. The exhaust system as defined in claim 21 wherein said muffler comprises a generally cylindrical, vertically extending housing with a cylindrical wall and wherein said gas inlet extends tangentially through said cylindrical wall.

23. The exhaust system as defined in claim 22 wherein said gas outlet is positioned vertically above said gas inlet and extends outwardly from said wall of said muffler spaced approximately 180° from said gas inlet.

24. The exhaust system as defined in claim 23 wherein said at least one water outlet extends from said cylindrical wall and is positioned below said gas inlet.

* * * * *

UNITED STATES PATENT AND TRADEMARK OFFICE

CERTIFICATE OF CORRECTION

PATENT NO. : 5,980,343
DATED : November 9, 1999
INVENTOR : Adam Rolinski

It is certified that error appears in the above-identified patent and that said Letters Patent is hereby corrected as shown below:

Abstract, line 11;
"comer" should be --corner--.

Abstract, line 18;
"quite" should be --quiet--.

Column 1, line 57;
"comer" should be --corner--.

Column 1, line 63;
"quite" should be --quiet--.

Column 5, line 24;
delete "a".

Column 6, line 19;
"be" should be --is--.

Column 8, line 11;
"Exhaust" should be --exhaust--.

UNITED STATES PATENT AND TRADEMARK OFFICE

CERTIFICATE OF CORRECTION

PATENT NO. : 5,980,343 
DATED : November 9, 1999
INVENTOR : Adam Rolinski

It is certified that error appears in the above-identified patent and that said Letters Patent is hereby corrected as shown below:

Column 9, line 5;
"e," should be --edge,--.

Signed and Sealed this

Seventh Day of November, 2000

*Attest:*

Q. TODD DICKINSON

*Attesting Officer*

*Director of Patents and Trademarks*